United States Patent [19]

Toupin

[11] Patent Number: 4,977,676

[45] Date of Patent: Dec. 18, 1990

[54] RAPIDLY ADJUSTABLE GUNSIGHT

[76] Inventor: David J. Toupin, 1717 Stricker Rd., Memphis, Ind. 47143

[21] Appl. No.: 412,148

[22] Filed: Sep. 25, 1989

[51] Int. Cl.[5] ..... F41G 1/06; F41G 1/18

[52] U.S. Cl. ..... 33/254; 33/260

[58] Field of Search ..... 33/252, 254, 259, 260, 33/233, 257, 258; 74/527, 533, 534, 535, 541; 42/100

[56] References Cited

U.S. PATENT DOCUMENTS

| | | | |
|---|---|---|---|
| 410,422 | 9/1889 | Long | 33/260 |
| 533,003 | 1/1895 | Dieffenbach | 33/260 |
| 535,379 | 3/1895 | Kennedy . | |
| 541,559 | 6/1895 | Lyman | 33/257 |
| 592,740 | 10/1897 | Kennedy . | |
| 658,709 | 9/1900 | Fischer . | |
| 684,226 | 10/1901 | Griffith . | |
| 847,643 | 3/1907 | Brockhaus | 33/252 |
| 937,244 | 10/1909 | Kennedy | 33/260 |
| 2,389,326 | 11/1945 | Reising | 33/260 |
| 3,481,217 | 12/1969 | Maeda | 74/535 |

*Primary Examiner*—William A. Cuchlinski, Jr.
*Assistant Examiner*—Daniel G. DePumpo
*Attorney, Agent, or Firm*—Vorys, Sater, Seymour & Pease

[57] ABSTRACT

A gunsight rapidly adjustable in elevation comprises a body adapted for mounting on a projectile weapon, an elongated sight leaf pivoted at one end on the body, the other end of the sight leaf carrying a sighting aperture, an arcuate toothed rack coupled to the sight leaf at its pivoted end, spring loaded detent means engaging the arcuate toothed rack to hold the sight leaf in a preselected position, and an adjusting lever, fixed at one end to the pivoted end of the sight leaf for adjusting the sight leaf in elevation.

11 Claims, 1 Drawing Sheet

RAPIDLY ADJUSTABLE GUNSIGHT

BACKGROUND OF THE INVENTION

1. Field of the Invention:

This invention relates to gunsights and more particularly to rear sights that are rapidly adjustable in elevation.

2. Brief Description of the Prior Art:

Gunsights for ballistic weapons used at relatively long ranges, such as rifles and the like, have long been made adjustable in elevation in order to permit the marksman to aim directly at the target while the muzzle of the weapon is elevated to impart to the projectile the correct trajectory to strike the target. Various mechanisms have been provided to permit the rear sight to be raised or lowered to permit accurate aiming at a target of greater or lesser range, and such rear sights have often been provided with scales or the like to indicate to the marksman the range at which the projectile will cross the line of sight.

Generally, in shooting with firearms, which have a relatively high muzzle velocity, sight adjustment in elevation is necessary only at relatively long ranges, e.g, a few hundred yards. At short ranges such adjustment is not necessary because the trajectory of the bullet is approximately flat for a few tens of yards. However, with weapons having a relatively low muzzle velocity, such as those powered by compressed gas, the effect of the drop of the projectile is apparent at much shorter ranges. In particular, in the recently developed paintball sports, wherein participants fire pellets of marking fluid with compressed gas weapons, a rear sight adjustable in elevation is useful when shooting at a range of a few tens of yards. Because the participants are engaged at such relatively short ranges, a rear sight adjustable in elevation rapidly and conveniently is a useful accessory to the player's weapon.

A number of the adjustable rear sights that have been developed for rifles and the like have been equipped with means for adjusting the position of the sight, for holding the sight in the selected position and for indicating the range at which the projectile will cross the line of sight Griffith, U.S. Pat. No. 684,226, discloses a sight comprising a base with upstanding flanges on each side and a sight leaf pivoted at its front end. An upturned rear end of the sight leaf carries a sighting aperture and forward-facing hooks which engage notches in the rear end of the side flanges of the sight base to retain the sight at its adjusted setting. In this sight the range can be read or estimated from the position of the sight-carrier relative to the flanges; however, adjustment of the range requires removing the gun from firing position.

Reising, U.S. Pat. No. 2,389,326, discloses a similar adjustable gunsight having a base member, upstanding side flanges and a sight leaf pivotably mounted within a body member and carrying a sighting aperture The sight leaf is provided with laterally extending projections which engage notches in the body member to fix the sight leaf at a selected angle, and a pointer which indicates the set range Adjustment of this sight also requires that the gun be removed from firing position to adjust range, and the range scale is visible only on the side of the flange.

Other inventors have attempted to provide rear sights which are rapidly adjustable in elevation.

Kennedy, U.S. Pat. No. 937,244, discloses an adjustable gunsight having a sight leaf pivoted at one end and carrying a rear sight aperture at the other. The angle of the sight leaf is adjusted by means of a lever attached to the pivoted end of the sight leaf. This lever comprises a plate having an arcuate aperture with an arcuate toothed rack mounted within the aperture. A spring-loaded detent engages the arcuate rack, and the plate is provided with indicia to indicate the range for which the sight is set. This sight permits rapid adjustment in elevation. However, the set range is only visible by inspecting the scale on the plate, which cannot be performed while the gun is held in firing position Long, U.S. Pat. No. 410,422, discloses a gunsight having a sight leaf pivoted at one end and having a side lever for adjusting the elevation. This sight does not appear to be provided with positive detent means.

Dieffenbach, U.S. Pat. No. 533,003, discloses a rear sight adjustable in elevation by moving a sight leaf, pivoted at its rear end and having a sighting aperture at its front end. An arcuate notched rack is formed integral with the pivoted sighting leaf and a spring-loaded detent mechanism engages the teeth of the rack to hold the sight in position. A scale is provided on the side of the arcuate rack to indicate the target distance Kennedy, U.S. Pat. No. 535,379, discloses a sight having a sight leaf pivoted at its front end and an arcuate rack attached to the sight leaf at the pivoted end The teeth of the arcuate rack engage the teeth of a straight rack affixed to a slider which is movable along the barrel of the gun, thus adjusting the sight in elevation. A second rack on the slide engages a pinion which is provided with a detent mechanism to hold the slide in the set position.

Kennedy, U.S. Pat. No. 592,740, discloses an adjustable sight having an adjustment mechanism similar to that disclosed in U.S. Pat. No. 535,379. The detent mechanism of this sight differs in that a spring loaded detent bears directly on the second linear rack of the slider to hold the sight in position.

Fischer, U.S. Pat. No. 658,709, discloses an adjustable sight having a sight leaf pivoted at its front end and an adjusting lever extending downward from one side of the sight leaf. The end of the lever engages a stepped slider which is moved along the barrel of the gun to adjust the angle of the sight leaf, while a spring latch holds the slider in the set position.

While these known adjustable sights provide for rapid adjustment, the distance scale is not visible to the marksman when he is looking through the sight aperture The mechanisms of the known rapidly adjustable sights also tend to be somewhat complex.

Accordingly, a need has continued to exist for a gunsight of simple construction which is rapidly and accurately adjustable in elevation while the marksman continues to hold the weapon in firing position.

SUMMARY OF THE INVENTION

This goal has now been achieved by a gunsight rapidly adjustable in elevation which comprises a body adapted for mounting on a projectile weapon, an elongated sight leaf pivoted at one end on the body, the other end of the sight leaf carrying a sighting aperture, an arcuate toothed rack coupled to the sight leaf at its pivoted end, spring loaded detent means engaging the arcuate toothed rack to hold the sight leaf in a preselected position, and an adjusting lever, fixed at one end to the pivoted end of the sight leaf, for adjusting the sight leaf in elevation.

Accordingly it is an object of the invention to provide a gunsight which is rapidly adjustable in elevation.

A further object is to provide a rapidly adjustable gunsight wherein the distance setting is visible to the marksman while sighting.

A further object is to provide a rapidly adjustable gunsight having a simple structure.

A further object is to provide a rapidly adjustable gunsight wherein the position of the adjusting lever can be changed for the greatest convenience of the marksman.

Further objects of the invention will become apparent from the description of the invention which follows together with the drawings. BRIEF DESCRIPTION OF THE DRAWINGS FIG. 1 shows a side elevational view of the gunsight of the invention mounted on a paintball gun.

DETAILED DESCRIPTION OF THE INVENTION AND PREFERRED EMBODIMENTS

Figure 1:
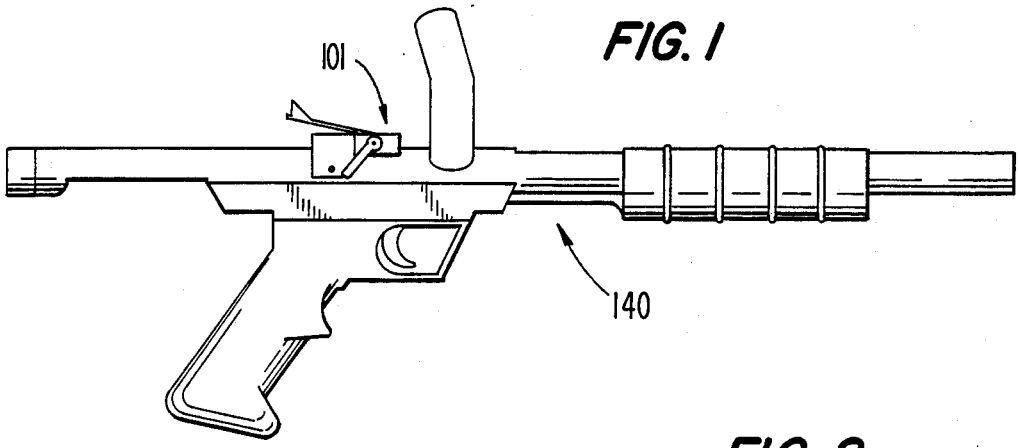

The gunsight of the invention will now be described with reference to the drawings wherein the same reference numerals refer throughout to the same elements of the sight.

The embodiment of the gunsight of the invention illustrated in the drawings is adapted for mounting on a paintball gun having a generally cylindrical barrel of circular cross-section. FIG. 1 shows a gunsight of the invention 101 mounted on a compressed gas paintball gun 140.

Figure 2:
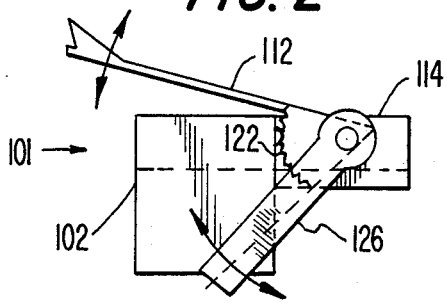
FIG. 2 shows a side elevational view of the gunsight
Figure 3:
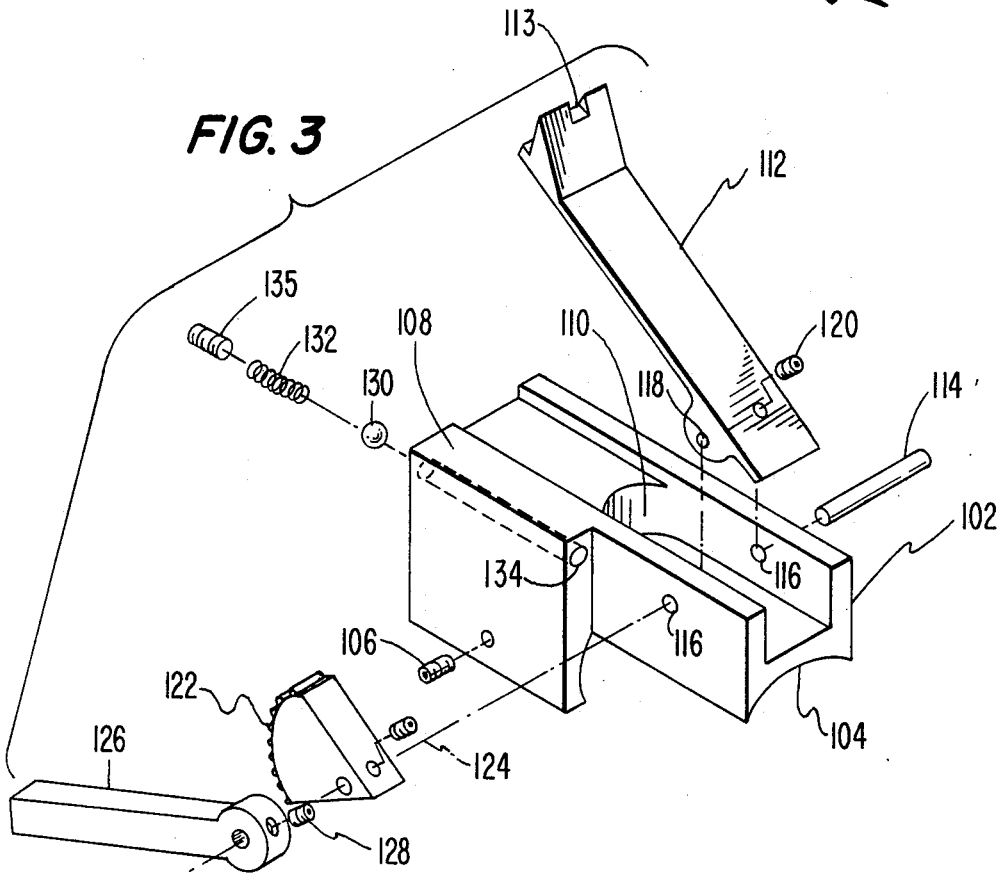
FIG. 3 shows an exploded view of the gunsight of the invention.

The gunsight, as can be seen in detail in FIGS. 2 and 3, comprises a body 102 which serves as the base upon which the components of the sight are mounted and also is provided with means for attaching the gunsight to the weapon. In the illustrated embodiment the sight is intended for mounting on a weapon having a barrel of generally circular cross-section, and the means for attaching the sight to the weapon comprises a surface 104 which is a generally cylindrical surface having a radius which matches that of the cylindrical barrel. The mounting means also comprises setscrews 106 in the body which when tightened grip the barrel of the weapon and hold the sight securely in place.

Alternatively, any conventional means for mounting the body of the gunsight on the weapon can be used. For example, the barrel or receiver of the weapon can be drilled and tapped to accept screws which hold the gunsight in position, or the frame of the weapon can be provided with dovetail recesses which mate with corresponding dovetails on the body of the gunsight.

The upper surface 108 of the body 102 is provided with an elongated recess 110 that receives a sight leaf 112. At that end of the body which is closer to the muzzle of the gun (front end) there is provided a transversely mounted pivot shaft 114 which is journaled in a pair of bearing holes 116. The pivot shaft 114 passes through a bore 118 at one end of the sight leaf 112 and the sight leaf 112 is fixed to the pivot shaft 114 by a sight leaf setscrew 120. The end of the sight leaf 112 opposite the pivot shaft 114 is provided with a sighting aperture 113. Alternatively, the sighting aperture may be carried on a separate element fastened to the end of the sight leaf opposite the pivot shaft 114 by means of screws or other fasteners.

In order to retain the sight leaf in the position set by the marksman, an arcuate toothed rack 122 is fixed to the pivot shaft 114 by rack setscrew 124. The arcuate rack 122 is positioned adjacent to the sight leaf where it is visible in the field of vision of the person sighting through the gunsight of the invention. The arcuate rack 122 is preferably angularly positioned on the pivot shaft 114 so that more of the rack is visible as the sight leaf is raised. In this way the amount of rack 122 which is visible can serve as an indication of the range for which the sight is set. The rack can also be marked or colored to provide an indication of the range In order to provide for rapid adjustment of the sight in elevation, an adjusting lever 126 is fixed at one end thereof to the pivot shaft 114 by adjusting lever setscrew 128. The adjusting lever 126 is angularly positioned on the pivot shaft 114 so that the free end of the adjusting lever 114 extends to a location where it is conveniently actuated by the finger or thumb of the marksman In this way the marksman can quickly adjust the elevation of the sight without removing the weapon from firing position.

The sight leaf is retained in the selected position by a detent 130 which is pressed against the teeth of the arcuate rack 124 by spring 132, mounted in detent sprinq bore 134 and retained therein by spring retaining screw 135. Preferably the detent 130 is a spherical element such as a ball bearing as shown. However, the detent 130 may be an elongated rod of round or rectangular cross-section or equivalent functional shape, provided that it presses against the teeth of the arcuate rack with sufficient force to hold the sight leaf 112 at the set angle while permitting relatively easy adjustment of the elevation angle of the sight leaf 112.

Alternate means for fastening together the parts of the sight may also be used. For example instead of the setscrews recited above which hold the sight leaf, arcuate rack and adjusting lever to the pivot shaft, these elements may be fastened with pins or rivets extending through the shaft or by clamps, or they may be welded, brazed or soldered to the shaft.

It is preferred however, that the adjusting lever be fixed to the shaft with a setscrew or clamp, or the like, which will permit the angle of the lever to be adjusted easily for the convenience of the individual marksman, as can be seen from FIG. 1, where the end of the adjusting lever is positioned generally near the trigger of the weapon where it can be easily adjusted by the marksman The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

I claim:

1. A rapidly adjustable gunsight comprising a body, means integral with said body for attaching said body to a projectile weapon, an elongated sight leaf having a first end and a second end, said first end of said sight leaf being pivotably attached to said body and said second end having a sight aperture, arcuate toothed rack means coupled to said sight leaf and positioned adjacent to said sight leaf, wherein said arcuate rack is readily visible by a person sighting through said sight aperture, detent means mounted on said body and engaging said arcuate rack to hold said sight leaf in a preselected position, and lever means coupled to said sight leaf for adjusting the position of said sight leaf.

2. The gunsight of claim 1 wherein said means for attaching said body to a gun comprises a surface adapted to fit against the barrel of the gun and setscrews to secure said sight to said gun barrel.

3. The gunsight of claim 1 wherein said detent means comprises a spring which urges a ball into engagement with the teeth of said arcuate rack.

4. The gunsight of claim 1 wherein said detent means comprises a spring which urges a pin into engagement with the teeth of said arcuate rack.

5. The gunsight of claim 1 wherein said lever is adjustably coupled to said sight leaf.

6. The gunsight of claim 1 wherein said detent means comprises a spring which urges a pin into engagement with the teeth of said arcuate rack.

7. The gunsight of claim 1 wherein said lever means is a cantilever lever.

8. A gunsight rapidly adjustable in elevation comprising a body adapted to be mounted on a hand-held projectile weapon, said body having a forward end positioned toward the muzzle of said weapon and a rear end positioned toward the breech of said weapon, a transverse pivot shaft journaled in bearings at the forward end of said body, an elongated sight leaf having a first end and a second end, said first end being fixed to said transverse pivot shaft, and said second end having a sight aperture, an arcuate toothed rack fixed to said transverse pivot shaft adjacent to said leaf, and angularly positioned on said shaft so that the teeth of said rack are moved within the field of vision of a person aiming the weapon when said second end of said sight leaf is elevated, a spring-loaded detent mounted on said body and engaging the teeth of said toothed rack, and lever means coupled to said shaft and extending radially therefrom.

9. The gunsight of claim 8 wherein said spring-loaded detent comprises a spring which urges a ball into engagement with the teeth of said arcuate rack.

10. The gunsight of claim 8 wherein said lever means is adjustably coupled to said shaft.

11. The gunsight of claim 8 wherein said lever means is a cantilever lever.

* * * * *